US008460159B2

(12) United States Patent
Mikhailenok et al.

(10) Patent No.: US 8,460,159 B2
(45) Date of Patent: Jun. 11, 2013

(54) DEVICE FOR STRENGTHENING SOFT PALATE MUSCLES

(76) Inventors: Eugene Mikhailenok, San Diego, CA (US); Olga Voronina, San Diego, CA (US)

( * ) Notice: Subject to any disclaimer, the term of this patent is extended or adjusted under 35 U.S.C. 154(b) by 63 days.

(21) Appl. No.: 12/913,641

(22) Filed: Oct. 27, 2010

(65) Prior Publication Data

US 2011/0130249 A1 Jun. 2, 2011

Related U.S. Application Data

(63) Continuation of application No. 10/974,307, filed on Oct. 27, 2004, now abandoned.

(51) Int. Cl.
*A63B 71/00* (2006.01)

(52) U.S. Cl.
USPC ..... 482/1; 482/8; 482/901; 482/13

(58) Field of Classification Search
USPC ..... 482/10–11, 13; 128/200.24, 878
See application file for complete search history.

(56) References Cited

U.S. PATENT DOCUMENTS 3,014,286 A * 12/1961 Hricak ..... 434/157
3,118,667 A * 1/1964 Barons ..... 482/11
3,895,533 A * 7/1975 Steier ..... 600/587
4,350,167 A * 9/1982 Heimlich ..... 600/540
4,981,295 A * 1/1991 Belman et al. ..... 482/13
5,213,553 A * 5/1993 Light ..... 482/11
5,361,987 A * 11/1994 Matheussen et al. ..... 239/33
H1557 H * 7/1996 Joubert et al. ..... 600/590
5,735,772 A * 4/1998 Schiavoni ..... 482/11
6,514,176 B1 * 2/2003 Norton ..... 482/11
6,524,225 B1 * 2/2003 Arias ..... 482/11
6,607,549 B2 * 8/2003 Huang ..... 606/234
7,059,332 B2 * 6/2006 Eli ..... 128/898
7,083,548 B1 * 8/2006 Moore et al. ..... 482/11
7,153,237 B2 * 12/2006 Norton ..... 482/11
2005/0192157 A1 * 9/2005 Norton ..... 482/11
2006/0124137 A1 * 6/2006 Fong ..... 128/848

* cited by examiner

*Primary Examiner* — Glenn Richman
(74) *Attorney, Agent, or Firm* — Lewis Kohn & Fitzwilliam LLP; Timothy W. Fitzwilliam

(57) ABSTRACT

A device for abatement to snoring and snoring disorders which tones and strengthens soft palate muscles. The device comprises inserting a tube into one's mouth; pressing the tube up to the hard palate; holding the tube in the mouth at the hard palate using the tongue; and initiating a sucking process over the tube. The sucking process requires the person to maintain constant suction on the tube member for between about 5 to 15 seconds followed by a relaxation for between about 5 to 20 seconds and repeating this process of suction, hold, and relaxation for between about 10 to 20 times. The device automates the process and records and stores data personal to the person.

8 Claims, 3 Drawing Sheets

DEVICE FOR STRENGTHENING SOFT PALATE MUSCLES

PRIORITY CLAIM

This utility patent application is a continuation of U.S. patent application Ser. No. 10/974,307, filed on Oct. 27, 2004, the entire contents of which is hereby incorporated by reference.

BACKGROUND OF THE INVENTION

This present invention relates to an improvement in the strengthening or toning of soft palate muscles as an abatement to snoring and snoring disorders, and more particularly to a unique method for such strengthening and toning and a specific device suited to facilitate such strengthening and toning.

Snoring is a common problem among many people; especially the aged. Referring to FIG. 1, simply put, snoring by a person 110 is a sound generated by the soft tissues of the nasopharynx 20 as air, incoming and outgoing, passes through the nasal ducts 15 and further through the nasal cavity 16 over the hard palate 17, or through the mouth 12 and the oral cavity 13 under the hard palate 17, when lower jaw 11 droops, during sleep.

Two particular groups of problems related to snoring for the snoring party are: [1] social-esthetical and [2] medical. As for the first, the snoring party can be annoying to the bed partner and, depending how loud the sound, how frequent, and how long, can cast the snoring party into an unflattering view.

The most important of these problems, however, is the physical and medical such as multiform sleep disorders and life threatening obstructive apnea [the temporary cessation of breathing]. The cause of snoring can be due to anatomic defects of the nasopharynx (e.g., nasal stenosis, an elongated lingula 19 of the soft palate, and the like). The most widespread cause of snoring, however, is due to a weakness, or weaker tonicity, of the soft palate muscles.

The soft palate is an anatomic part of the nasopharynx which aids one in the functions of swallowing, in suction, and in phonation. It basically is a muscle-cartilage slab, located dorsally of the hard palate. The thin muscle layer which is basic material composing the soft palate and which dorsally extends past it, forms the lingula. These muscle segments [i.e., the soft palate and the lingula are referred to as the soft palate muscles] are relatively strong and well toned in children and young adults. Such strength and tonicity generally prevents snoring. For that reason, snoring is relatively rare in children and young adults.

But as one ages, the tonicity of muscles of the soft palate become less toned and weaker. As one then sleeps supine, on their backside, the weakened soft palate muscles cannot prevent a sagging of the soft palate which then lies more loosely and down toward the nasopharynx. In such a condition, as air passes by, because the soft palate muscles are not as toned or as strong as before, it may flap and vibrate; and snoring often results. It is estimated that more than 60% of people over 50 snore while sleeping. Approximately 10% of these snorers also suffer from apnea, the most clinically dangerous form of snoring (referred to as obstructive apnea).

Current treatments for mild forms of snoring include the following:

a. changing one's position while sleeping (not sleeping in the supine position but rather making a conscious effort to sleep only on one's side or in a prone position);

b. purchasing and using special pillows; and c. engaging in pharmacological remedies, such as peels and sprays, which are designed to prevent excessive moisture concentration and congestion in the nasopharynx.

Though well suited for their intended purpose of minimizing snoring or preventing it, these treatments are temporary in nature and attack and treat only the symptoms of snoring but not primary cause of it. As a result, these methods and treatments are limited in their effectiveness.

For more severe forms of snoring, the following treatments are typical:

a. masks or other passive appliances (such as gears and other apparatus) for displacing the lower jaw and moving it forward thus opening the nasopharynx to create a better clearance for the airflow as one sleeps; and b. special active devices that generate a permanent high-pressure flow of air in and through the airways as one sleeps [known as Continuous Positive Airway Pressure (CPAP)] therapy.

These technologies, as much as the previously described ones, also do not attack a primary cause of snoring; i.e., weakened soft palate muscles. Because these treatments are symptomatic only, those being treated with these regimens must continue to use them for the duration of their lives. These treatments are cumbersome and uncomfortable. Primarily because of the discomfort associated with such treatments and that they are treatments of the symptoms rather than the causes of snoring, more than 20% of the persons targeted for these regimens have refused them or, after having tried them, have discontinued their use.

The most effective regimen involves surgery of which several surgical procedures were developed. These include:

a. cryogenic or laser treatment of the palate tissues. Such treatment creates scar tissue to the treated palate region. The tissue thereby thickens and becomes tougher or harder which results in an alteration of its resonance characteristics;

b. resectioning of the lingua and a brim of the soft palate;

c. more complicated surgeries that increase the nasopharynx clearance.

Surgical regimens are more intrusive, more costly, and, of the more complex nasopharynx surgery, more dangerous. As with all forms of surgery, other complications, such as, but not limited to narcosis and blood loss, may result. Other less serious consequences often result from surgical procedures of this nature. These may include snuffling voice, swallowing difficulties, and the internal mis-direction of ingested food into the nasal ducts and nasopharynx rather than into the esophagus during the swallowing process. Therefore, surgical intervention should be employed only in and for life-threatening situations.

The present invention is a non-invasive manner of addressing and correcting a root cause of snoring, is simple in approach and execution, and is more permanent in nature than the prior art approaches, devices, and methods of treatment.

As such, the present invention is based on a pathogenetical approach to the abatement of snoring and, as such, is directed at a major cause of the snoring, weak soft palate muscles 18 and comprises an automated device. The device of the present invention strengthens and reinforces the soft palate muscles 18 by means of an specialized and regimental training program specific to these muscles which requires repeated and progressive active contraction of the soft palate muscles 18 which, by following this process, over time and cycle, causes a gradual increase in mass and firmness of the soft palate muscles 18 and results in the following benefits:

a. strengthening and toning the soft palate muscles which has the effect of it being more horizontally disposed which thereby increases the nasopharynx clearance 23 and, by such clearance, decreases or limits any resistance to airflow; and b. with such strengthening and toning, changes the resonance characteristics of the soft palate and thereby prevents emersion of sound oscillations in the incoming and outgoing airflow.

The suggested device of the present invention for the strengthening—of soft palate muscles for the abatement of snoring has an important distinction from all currently existing methods, procedures, and devices, which at best are temporary and at worst, are invasive and cumbersome. A soft palate and associated muscles trained, toned, and strengthened through the device of the present invention retain their high tonicity and strength for a longer period of time after the course of training has concluded. This in turn provides for a longer-term desired result for the person. Maintaining the regimen of the present invention will yield even greater, if not more permanent positive results.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a device for abatement to snoring and snoring disorders which calls for training to tone and strengthen soft palate muscles by inserting a tube member into one's mouth; pressing the tube member up to the hard palate; holding the tube member in the mouth at the hard palate using the tongue; and initiating a sucking process over the tube member. The sucking process requires the person to maintain constant suction on the tube member for between about 5 to 15 seconds followed by a relaxation for between about 5 to 20 seconds and repeating this process of suction, hold, and relaxation for between about 10 to 20 times. The device for this toning and strengthening process comprises an airtight container; a tube member extending from the airtight container for use by a person to engage in one or more contraction phase (CtPh); a control means connected to the airtight container for determining a person's maximum contraction level (MxCtLv) during one of the one or more CtPh and for establishing said person's pressure reference level (RfLv) during one of the one or more CtPh; and a pressure-sensing component in communication with the airtight container and the control means for measuring pressure in the airtight container during the one or more CtPh and during MxCtLv.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 2:
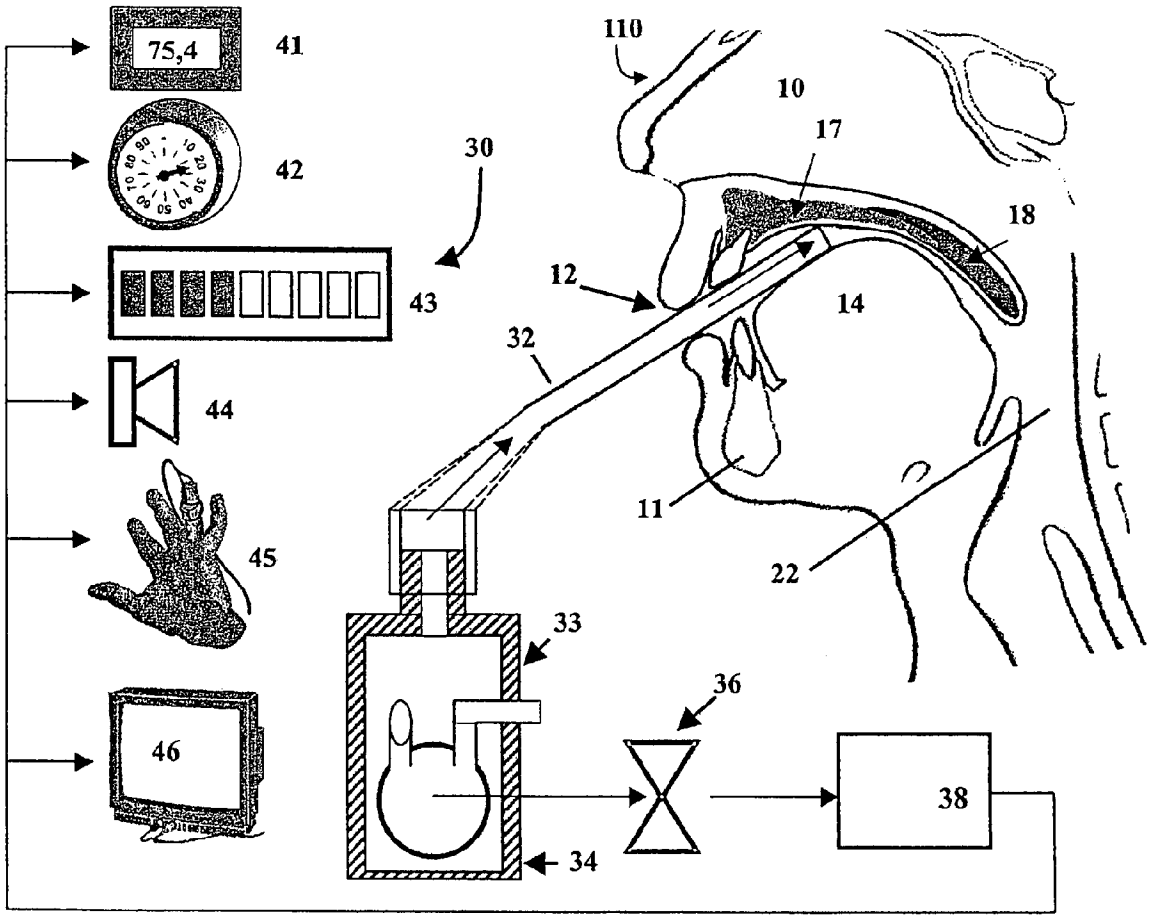
FIG. 2 is a schematic diagram of the of the snoring abatement device.

In the normal course of sucking liquid from a container through a straw 32 [see FIG. 2] or similar tube-like or elongate object, several muscles are at play and work synchronously with one another [for the purpose of discussion only and not by means of limitation and unless otherwise indicated, the term straw or tube will be used for such tube-like objects].

Figure 1:
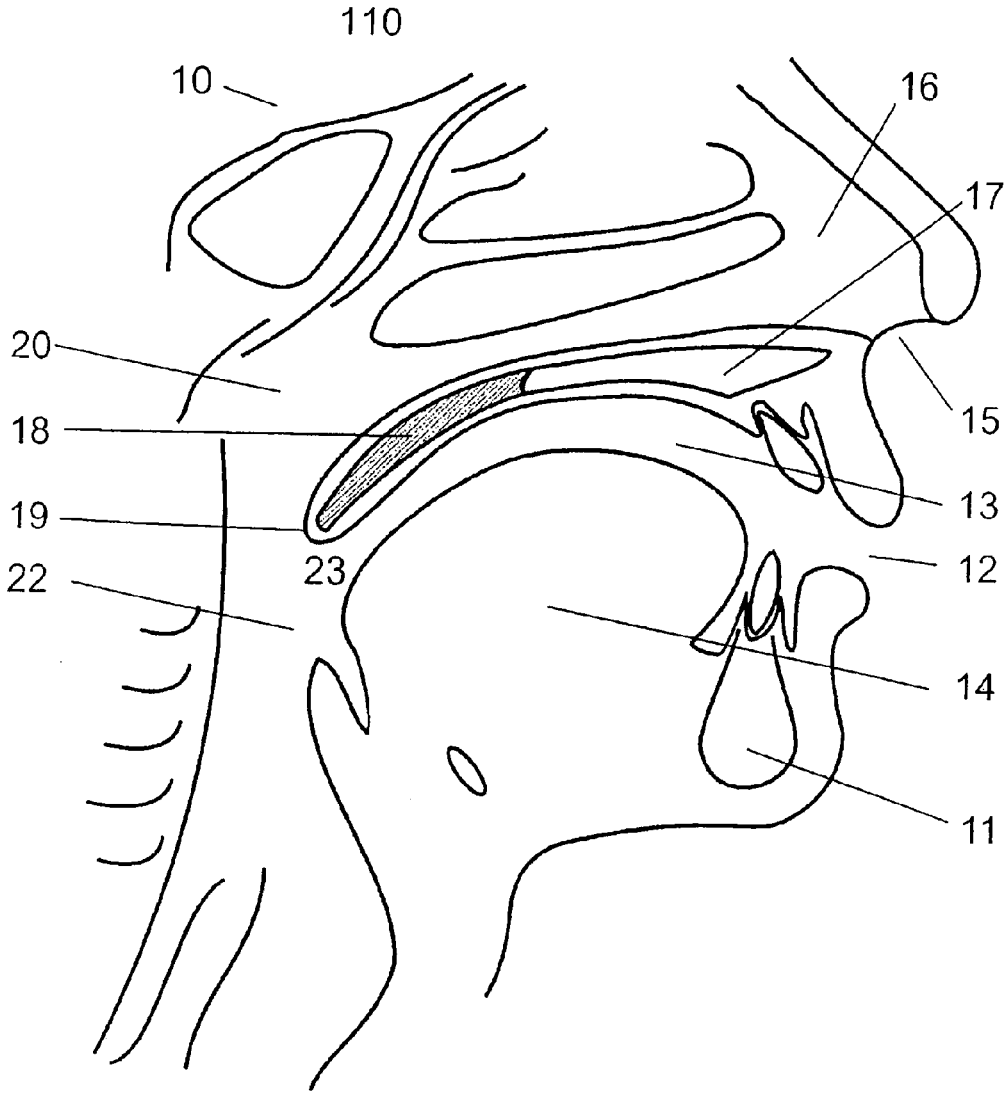
FIG. 1 is detailed cross-sectional side view of a person's head.

Referring to FIG. 1, reference character 110 represents a person and reference character 10 represents the detailed cross-section of the person's head so as to better illustrate the body parts/muscles at play while engaging in suction efforts through a straw 32. Generally, these are the muscles of tongue 14, cheeks 22, and soft palate muscles 18. To initiate a sucking process, the muscles engage in a "work-out" by contracting. The object of the present invention is to direct the process of contraction only to the soft palate muscles 18 such that generally these muscles are the muscles being trained and to exclude the influence other muscles have in the sucking process by minimizing, if not preventing, their contraction. Placement of the straw 32 into the mouth 12 of a person is important to the process of the present invention.

Reference is now made also to FIG. 2. In this illustration, the upper end of the tube 32 is to be placed into the person's mouth 12 approximately 2 inches into the mouth past the lips, pushed up to the hard palate 17 and held there with the tongue 14. Two inches is used herein for ease of explanation. What is necessary is to place the "tube 32 far enough into the mouth onto the hard palate 17 so as not to engage the cheek muscles by not placing the tube 32 far enough' in and not so far in that the tube 32 induces vomiting. Placement of the tube 32 into the hard palate 17 between approximately 45% to approximately 75% of the full distance of the hard palate 17 is generally sufficient and, in most people will equate to approximately or at least 2 inches.

Placement and retention of the straw 32 at the hard palate 17 virtually prevents activation of the other muscles [i.e., tongue 14 and checks 22] in the sucking process and minimizes the involvement of the muscles at the root of the tongue [radix linguae] and to aid in maintaining the straw 32 in place. As such, it is the soft palate muscles 18 which primarily engage in 12 the sucking process.

As described above, approximately 35 such sessions are generally the optimum for a person 110 undergoing this regimen in 16 order to attain a sufficiently high degree of tonicity as to significantly reduce and, in most cases, eliminate the act of snoring. Approximately 35 sessions also are generally the optimum in order to maintain that high level of tonicity for a greater period of time thereby permitting the person to discontinue the training sessions until, and if, snoring recurs. If, when, snoring recurs, the person should resume the training and toning of the soft palate muscle 18 in the manner and duration described above.

The automated device for the training of the soft palate muscles 18 is best reflected in FIG. 2, reference character 30. The device comprises a sealed airtight container 33 with a tube 32 attached thereto. Located within the container 33 or adjacent to the container 33 is a conventional pressure sensor component 34. A person 110 inserts tube 32 into the mouth 12 and up to the hard palate 17 [as described above for the non-automated process so that only the target muscle group is employed in the contraction phase (CtPh)].

The pressure within the container 33 is basically at atmospheric pressure [atm], approximately 1013.25 millibars [mb]. For this process a reference point [RfPt] also must be attained. The reference point [RfPt] here is a pressure level, or reference level [RfLv]. RfLv is different for each person and is established for each person in the following manner. The person after proper placement of the tube 32 adjacent to the hard palate 17, first initiates the suction process exerting maximum force during this contraction phase [CtPh]. The pressure sensor 34 measures the pressure within the container 33 as attained by the person after exerting maximum contraction effort. This is referred to as the maximum contraction level [MxCtLv] pressure.

The atmospheric pressure level [atm] minus the maximum contraction level [MxCtLv] represents the change [Δ] in pressure inside the container 33. It is from this change [Δ] in pressure that the training variable [TrVr], and concomitant reference level [RfLv], are established. For this mode of training, TrVr is a predetermined percentage of A ranging from approximately 40% to approximately %60. In this regard, and using 50% as the predetermined percentage:

$$RfLv=atm-TrVr \text{ or } MxCtLv+TrVr$$

By way of example, where atm=1000 mb; and MxCtLv=600 mb; then Δ=400 mb, and since TrVr=50% of Δ[400 mb] for 200 mb; then RfLv=800 mb [1000 mb (atm)−200 mb (TrVr) or 600 mb (MxCtLv)+200 mb (TrVr)].

Figure 3:
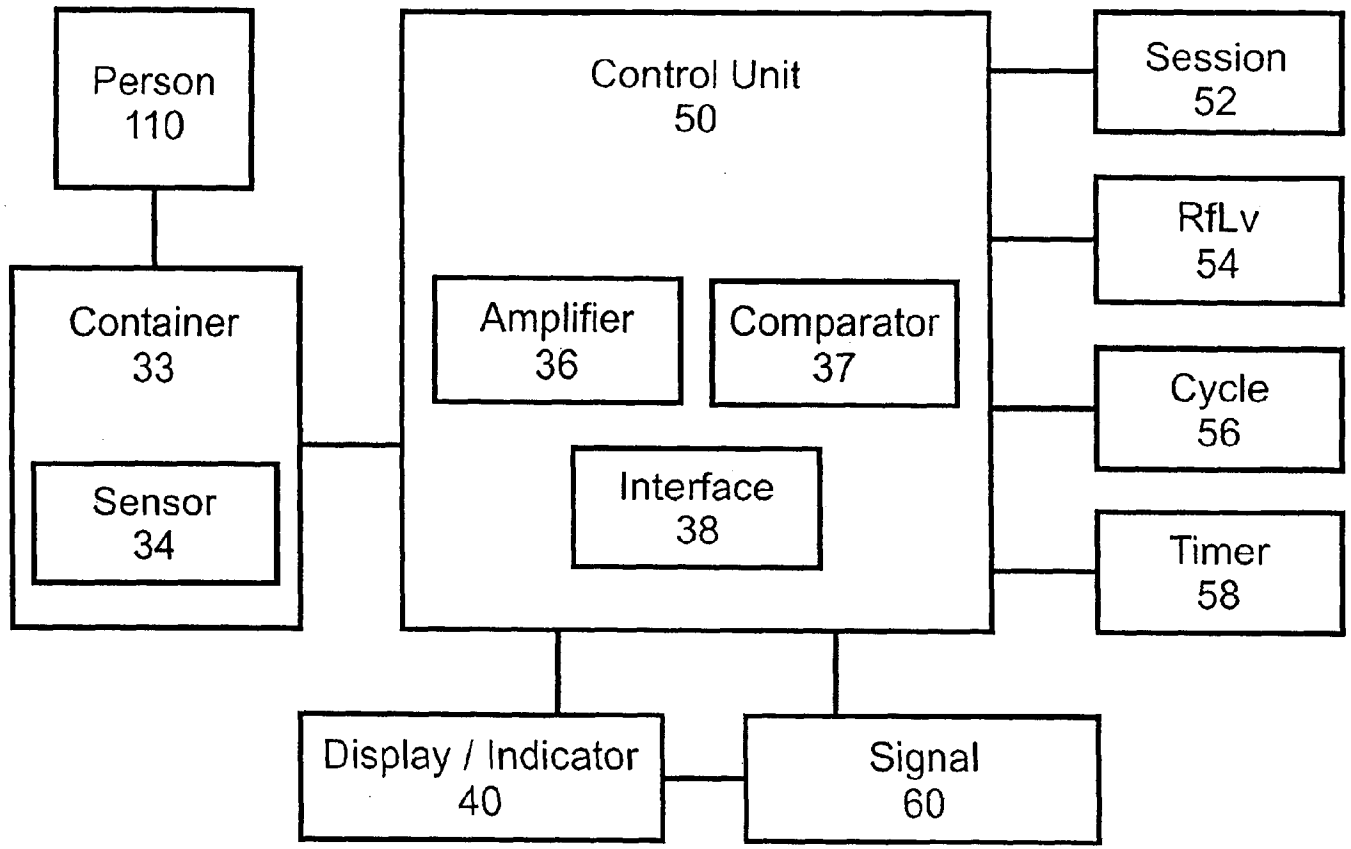
FIG. 3 is a block diagram of the basic components of the snoring abatement device.

FIGS. 2 and 3 reflect the structure and operation of the automated device 30. When a person initiates the suction process [contraction phase (CtPh)] the pressure inside the container 33 changes and is measured by the pressure sensor component 34. The pressure sensor component 34 transmits a signal to a conventional amplifier 36. The output of the amplifier 36 is connected through a suitable conventionally available interface module component 38 and to a suitable and conventionally available indicator component 40 for the person to see or hear or feel or any combination thereof. Any conventional communication device or indicator component 40 can be used for this purpose and may be individually selected by the person. As illustrated in FIG. 2, such indicator components may include:

a. a digital display component 41 digitally reflecting the level of pressure;

b. a scale-type component 42 [as in a clock-type display] reflecting the level of pressure;

c. a analogue component 43 reflecting the level of pressure through photo-light indicators, bar graph form, and the like;

d. a sound generating component 44 reflecting the level of pressure through changes in sound tone, volume, type, and pitch;

e. an electrical stimulus component 45 or tactile irritator/vibrator component which triggers on when the person is not exerting sufficient contraction effort and/or the RfLv is not being attained;

f. a screen/monitor component 46 reflecting the level of pressure in video and/or audio format or through a program pleasing to the person (such as a movie, a slide-show, a musical file, etc). The program is interrupted or interfered with when the person is not exerting sufficient contraction effort and/or the RfLv is not being attained. When the proper level is attained, the program resumes.

In this automated embodiment of the device 30, once the RfLv is established it is recordable and retainable within the control unit 50 of the device 30 using any conventional read-only, read-write, or read-rewrite component, or any combination thereof. Such recording and retention may be through an internal conventional memory source or an external conventional memory source [compact disk, floppy disk] insertable and readable by the device 30. The RfLv is associated with an ID unique to the specific person. Once the ID and RfLv is set for a specific person, the sessions follow specific procedures each of which are recorded and retained.

As described for the non-automated method, in this automated approach there also are multiple sessions [Se], each session [Se] comprises one or more cycles [Cy] (typically more than one Cy for an Se), and each cycle [Cy] comprises two phases [Ph]; the suction or contraction phase [CtPh] and the rest or relaxation phase [RxPh]. At the first session [Se], the RfLv is established. The person then undergoes one or more cycles [Cy] of training with each Cy comprising one CtPh of about 5 to 15 seconds duration followed by one RxPh of about 10 to 20 seconds. It has been found that approximately 20 Cy per session will produce good results. These ranges of duration accommodate the strengthening and toning of the soft palate muscle 18 as the contraction period is sufficient to exert, without over-straining, those muscle groups as necessary and the rest period is sufficient to restore those muscle groups to their full contraction potential and ready them for the next contraction.

The sessions [Se] 52, RfLv 54, and cycles [Cy] 56 are retained by the device 30, either through an internal or an external memory source. A conventional timer component 58 within the device 30 measures the duration of each phase and when the time limit has been attained, transmits a signal 60 to the person via the suitable display/indicator component 40. The signal transmitted directs the person to cease the current phase [CtPh or RxPh] and begin the next respective phase [RxPh or CtPh].

These times can be adjusted to meet the particular needs, strengths, and weaknesses to the specific person. A 10-second CtPh followed with a 15-second RxPh has been found to produce the best and most effective results in the most efficient manner.

The control unit 50 counts and records each session 52. A conventional comparator component and counter 37 within the device 30 analyzes the contents of the counter, initiates incremental increases to the cycles [Cy] in the current session [Se] as necessary, and when the total cycles [Cy] for that session [Se] have been attained the unit shuts down.

For best result in this training, the number of Cy should incrementally increase by between about 2-10 additional Cy with one or more succeeding Se. Better results are realized if after every 5 Se, the number of Cy increases by 5. Therefore, for better results, with each increment of five sessions, the number of cycles is increased by five. The RfLv remains the same.

In this regard, for sessions [Se] 1-5, the person undergoes 20 cycles [Cy] as described above. After session 5, the control unit 50 increases the cycle [Cy] count to 25 for the next five session [Se 6-10]. After session 10, the control unit 50 increases the cycle [Cy] count to 30 for the next five sessions [Se 11-15]. After session 15, the control unit 50 increases the cycle [Cy] count to 35 for the next five session [Se 16-20], and so on. Since generally there are to be 35 sessions and up to 50 cycles [Cy], the cycle [Cy] count during Se 31-35 is 45. After completion of Se 35, the Cy increments to 50 Cy and the training is concluded.

The number of sessions [Se] a person has completed is retained. As such, the maximum number of cycles [Cy] a person is to perform is predetermined for each succeeding session [Se]. When the person completes the final cycle [Cy] of a session [Se], the device 30 automatically shuts down and powers off. No further signals are emitted and that particular session [Se] is over.

The components and power source for this automated device 30 are conventionally available. The power source may be AC or DC. What is important to this invention is the methodology; establishing the RfLv, performing each session [Se] with the appropriate number of cycles [Cy] having the two phases each of a specified duration, incrementally increasing the number of cycles [Cy] as described above, and ending the session [Se] after the last predetermined cycle [Cy] for that session [Se] has been completed.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts and method steps may be resorted to without departing from the spirit and scope of the invention. Accordingly, the scope of the invention should be determined not by the embodiment[s] illustrated, but by the appended claims and their legal equivalents.

The invention claimed is:

1. A device for strengthening soft palate muscles comprising:

(a) an airtight container;

(b) a tube member extending from said airtight container configured to be pressed against a user's hard palate, said tube member being held in a mouth by the user's tongue for engaging in a contraction phase (CtPh); and (c) a pressure-sensing component in communication with said airtight container and providing pressure indication for a training cycle.

2. The device of claim 1 further comprising a control unit for measuring, recording and analyzing parameters during a plurality of training cycles.

3. The device of claim 2, the control unit further comprising:

an amplifier to amplify a signal from the pressure sensing component;

a comparator for tracking a number of the plurality of training cycles;

a timer for measuring a duration of an individual training cycle; and a memory device for recording training cycle parameters.

4. The device of claim further comprising a communication component attached to said control unit for communicating attainment or non-attainment of a training goal.

5. The device of claim 4 wherein said communication component is selected from the group consisting of visual components, auditory components, and tactile components.

6. A device for strengthening soft palate muscles comprising:

an airtight container;

a tube member extending from and coupled to the airtight container; and a control unit for measuring, recording and analyzing parameters during a plurality of training cycles, wherein a training cycle comprises placing a proximal end of the tube member against a user's hard palate and the user performing sucking exercises.

7. The device for strengthening soft palate muscles of claim 6 further comprising a pressure-sensing component in communication with said airtight container and providing pressure indication for the training cycle.

8. The device for strengthening soft palate muscles of claim 7 further comprising:

an amplifier to amplify a signal from the pressure sensing component;

a comparator for tracking a number of a plurality of training cycles;

a timer for measuring a duration of an individual training cycle; and a memory device for recording training cycle parameters.

* * * * *

UNITED STATES PATENT AND TRADEMARK OFFICE

CERTIFICATE OF CORRECTION

PATENT NO. : 8,460,159 B2
APPLICATION NO. : 12/913641
DATED : June 11, 2013
INVENTOR(S) : Mikhailenok et al.

It is certified that error appears in the above-identified patent and that said Letters Patent is hereby corrected as shown below:

In the Claims:

Col. 8, line 16: After the word "claim" and before the word "further" insert the number --2--.

Signed and Sealed this
Twenty-seventh Day of May, 2014

Michelle K. Lee

Michelle K. Lee
*Deputy Director of the United States Patent and Trademark Office*